United States Patent [19]

Watanabe et al.

[11] Patent Number: 4,836,978

[45] Date of Patent: Jun. 6, 1989

[54] METHOD FOR MAKING VACUUM CIRCUIT BREAKER ELECTRODES

[75] Inventors: Ryuji Watanabe, Toukai; Hisashi Andoh, Hitachi; Kiyoji Iwashita, Hitachi; Kinko Shimizu, Hitachi, all of Japan

[73] Assignee: Hitachi, Ltd., Tokyo, Japan

[21] Appl. No.: 92,138

[22] Filed: Sep. 2, 1987

[30] Foreign Application Priority Data

Sep. 3, 1986 [JP] Japan ..... 61-205976

[51] Int. Cl.[4] ..... B22F 3/24

[52] U.S. Cl. ..... 419/10; 419/12; 419/13; 419/19; 419/23; 419/28; 419/47; 419/49; 419/54; 419/55; 419/58

[58] Field of Search ..... 419/23, 47, 49, 55, 419/58, 10, 12, 13, 19, 28, 29, 54

[56] References Cited

U.S. PATENT DOCUMENTS 4,547,639 10/1985 Watanabe et al. ..... 419/6

4,626,282 12/1986 Naya et al. ..... 75/247

4,719,078 1/1988 Miyashita et al. ..... 419/53

*Primary Examiner*—Stephen J. Lechert, Jr.

*Attorney, Agent, or Firm*—Antonelli, Terry & Wands

[57] ABSTRACT

A production method of a vacuum circuit breaker electrode comprises the steps of mixing conductive metal powder, and refractory material powder with a higher melting point than said conductive metal powder, compacting the resultant mixture to form a compact, presintering the compact in a atmosphere of high purity hydrogen, sealing a presintered body in a capsule while exhausting, heating and degassing, and subjecting the sealed capsule to hot isostatic pressing treatment. The conductive metal powder is one or both of Cu and Ag. The hot isostatic pressing treatment is effected at a temperature higher than a melting point of the conductive metal so that the presintered body is sintered under liquid phase, and a part of molten conductive metal component is seeped out on a sintered body surface.

18 Claims, 2 Drawing Sheets

METHOD FOR MAKING VACUUM CIRCUIT BREAKER ELECTRODES

BACKGROUND OF THE INVENTION

This invention relates to a process of producing electrodes for vacuum circuit breakers and, more particularly, to an improvement on a process of producing the electrodes through mixing raw materials of powder and sintering the resultant mixture.

The invention is suitable in use for production of Cr-Cu base electrodes, for example, which contain Cr as a main component and Cu. The Cr-Cu base electrodes for vacuum circuit breakers can be widely used, for example, for changeover switches for vehicles, vacuum circuit breaker for wide use, etc.

It is known that vacuum circuit breaker electrodes which are constructed of conductive metal of Cu or Ag and refractory metal having a higher melting point than the conductive metal have a high withstand voltage and are suitable for interruption of a large amount of electric current. As the refractory metal, for example, Cr, Co, Ni, Fe, Ta, W, Mo, etc. are used and, in particular, Cr of those metals is used most widely.

As production methods of vacuum circuit breaker electrodes, a melting method of electrode production through melting raw materials and solidifying it to form an alloy for electrodes, or a sintering method of electrode production through sintering raw material powder is generally used. Usually, the sintering method is used for such electrode material that is low in solubility and difficult to be made into an alloy, such as a combination of Cu and Cr, or for such electrode material that is separated into two components when melted, such as a combination of Cu and Fe, a combination of Cu and Co, etc.. Japanese Patent Laid-Open No. 50-55870 discloses details about production of electrodes consisting of conductive metal and refractory metal by sintering.

Of many methods of producing vacuum circuit breaker electrodes by sintering, a method of mixing and compacting raw materials of powder and then sintering the compact, which is similar to a method described in the Japanese Patent Laid-Open No. 50-55870, is the main method current.

The production of electrodes by a sintering method is always accompanied by a problem of oxidation. The Japanese Patent Laid-Open No. 50-55870 proposes sintering in a high vacuum or in a reducing atmosphere as measures for preventing the oxidation.

The inventors confirmed that electrodes which consist of conductive metal and refractory metal and are produced by sintering have large variation in withstand voltage. Even if the raw materials of powder are degassed in advance, or the sintering is effected in vacuum or in a reducing atmosphere, the variation in withstand voltage could be almost never improved. From these facts, it is found that the electrode production technique using the conventional sintering methods is not suitable for a method of producing electrodes having high withstand voltage.

The Japanese Patent Laid-Open No. 50-55870 does not discloses anything about withstand voltage characteristics and suggests nothing about relationship between sintering methods and the withstand voltage.

Summary of the Invention

An object of the present invention is to provide a method of producing vacuum circuit breaker electrodes which are constructed essentially of conductive metal and refractory material and which have high withstand voltage and small variation of the withstand voltage.

The invention resides in that conductive metal powder and refractory material powder of a higher melting point than the conductive metal powder are mixed, the resultant mixture is compacted, the compact is presintered in a hydrogen atmosphere, and then the presintered body is subjected to a hot isostatic pressing treatment thereby to be sintered.

In the hot isostatic pressing treatment step, the presintered body is sintered under liquid phase by heating at a temperature which is higher than a melting point of the conductive metal and lower than a melting point of the refractory material, whereby the conductive metal is melted and a part thereof is seeped out on the surface of the sintered body.

The invention is based on finding the fact that by employing hot isostatic pressing treatment (referred to as HIP treatment hereunder) as sintering means of vacuum circuit breaker electrodes and by presintering in the hydrogen atmosphere prior to the HIP treatment, withstand voltage of the electrodes can be made high and variation or scattering in the withstand voltage can be made less. Only by the mixing raw materials of powder and subjecting to the HIP treatment, withstand voltage characteristic and variation in the withstand voltage can not be improved and such a method does not make a large difference from a method of sintering raw materials in vacuum or in a reducing atmosphere.

Electrode material used in the invention consists essentially of conductive metal and refractory material, however, low melting point metal such as Pb, Bi, Sn can be contained in addition to the above materials.

The conductive metal is selected from Cu and Ag, and one of them or both can be used. When both of them are used, alloy powder of Cu and Ag, or a mixture of Cu powder and Ag powder also can be used.

The refractory material should have a higher melting point than the conductive metal, in particular, desirable is material selected from Cr, Co, Fe, Mo, W, Ta and Ni, which are higher in withstand voltage than the conductive metal. Cr is the most desirable of those metals.

The refractory material is not limited to metal. Ceramics also can be used. As such ceramics, various kinds of metal oxides, metal carbonates, metal nitrides, metal borides, metal silicides, etc. can be used.

Electrodes including Cr, produced by a sintering method and electrically contacted with each other can be easily separated when they are opened and have excellent welding resistance since Cr has a high withstand voltage and in addition thereto a sintered body of Cr is very weak. When Co and Fe are used as the refractory material, it is necessary to add a low melting point metal such as Pb, Bi, etc. in order to raise welding resistance. However, when Cr is used, it is not necessary to add such a low melting point metal, whereby composition of the electrode material can be simplified.

The object of invention is to produce the vacuum circuit breaker electrodes of high withstand voltage, so that with respect to composition ratio between the conductive metal and refractory material, it is better for the refractory material to have larger composition ratio. Concretely, it is preferable that the refractory material is adjusted to 50–90 wt % of all the electrode weight.

When the electrodes include low melting point metal such as Sn, Bi, an amount thereof is desirable to be adjusted to less than 5% of all the electrode weight.

Particle size of raw material is desirable to be as fine as possible in order to obtain sintered material of high density. It is desirable to be less than 200 μm and, particularly, less than 100 μm.

It is known, for example, in Japanese Patent Publication No. 54-8601 to employ the HIP treatment when vacuum circuit breaker electrodes are produced by a sintering method. However, in such a known method, raw material powder is hermetically enclosed in a capsule and subjected to HIP treatment, but presintering is not effected before the HIP treatment. Further, the object for invention described in the Japanese Patent Publication No. 54-8601 is electrodes containing a low melting point metal as an essential component. Even if the method that the raw material powder is sealed in the capsule and subjected to the HIP treatment thereby to sinter without subjecting to any other treatments, is applied to the production of electrodes consisting of conductive metal and refractory material, sufficient effects of making withstand voltage high and preventing variation in the withstand voltage can not be obtained.

As mentioned previously, the invention comprises, as essential steps, presintering in a hydrogen atmosphere and then subjecting to HIP treatment, wherein liquid phase sintering is effected by heating at a temperature which is higher than a melting point of the conductive metal and less than a melting point of the refractory material.

It is thought that improvement on the withstand voltage and the variation in the withstand voltage by this production method is greatly influenced by high purification of the electrode and a great reduction in entrance of gas such as $O_2$ or oxides into the electrode.

Further, the electrode material is shifted to the HIP treatment step after sufficiently degassing at the presintering step, so that it seems to contribute to the improvement on the withstand voltage characteristic that sintered material which is a little in defect and dense can be obtained.

In the electrode production method according to the invention, to compact the raw material powder in a shape of an electrode in advance and to presinter the compact in the hydrogen atmosphere thereby to reduce oxides prevent the electrodes from being deformed in shape at the time of the HIP treatment, reduce an amount of machining for finishing the electrode and are effective for raising a yield of the material.

In case that raw material powder as it is contained in a capsule and subjected to HIP treatment, it is difficult to form a desired electrode shape and it is necessary to subject a relatively large part thereof to machining after the HIP treatment to finish the electrode in a predetermined shape.

It is very desirable for obtaining a high-density sintered body to degass the raw material in advance through vacuum degassing treatment or heating in the reducing atmosphere, prior to the presintering step.

The presintering is necessary to be effected in a hydrogen atmosphere. In case that the presintering is effected in vacuum, oxides can not be reduced sufficiently. In particular, the reduction of Cr oxides is insufficient. Even if material presintered in vacuum is subjected to the HIP treatment, withstand voltage characteristics can be almost never improved.

In the presintering step, it is desirable to effect solid phase sintering without melting the raw material powder. A preferable temperature of the presintering is a temperature immediately below a melting point of the conductive metal.

Dew point of the hydrogen atmosphere in which the presintering is effected is adjusted to less than −70° C. and it is preferable to reduce oxides in a hydrogen atmosphere which is purified highly.

Porosity of the presintered body is desirably less than 20%, whereby in the later HIP treatment, gas is occluded a little and a sintered body which is small in defect such as oxide residues can be obtained.

As mentioned above, a high-density sintered body can be produced by subjecting to the HIP treatment after presintering in the hydrogen atmosphere in advance, and sintering under liquid phase. The reason for which the high-density sintered body can be obtained is that the pores are made effectively easy to be broken by the HIP treatment since most of the oxides are reduced at the time of the pretreatment and gas is almost never occluded in the pores. Further, it is effective that the conductive metal is melted and covers the surrounding of the refractory material powder, whereby an oxide removing effect is raised.

A combination of the conductive metal and ceramics is less in wettability. It is difficult to obtain a dense sintered body by a conventional sintering method. However, presintering in the hydrogen atmosphere and the HIP treatment according to the present invention can make a sintered body having strength enough to use as vacuum circuit breaker electrodes.

A heating temperature at the HIP treatment is in a range wherein the conductive metal melts and the refractory material does not melt. In practice, it is preferable that the heating temperature is between the melting point of the conductive metal and a temperature of 200° C. higher than the melting point.

According to an experiment in which Cu powder and ceramics powder are presintered in a hydrogen atmosphere, the presintered body is sealingly enclosed in a metal capsule and a HIP treatment is conducted with a static pressure of 2000 kg/cm$^2$ applied thereto, gas occluded in the sintered body is remarkably small and the sintered body is very high in density.

Further, in case of the HIP treatment, it is desirable to enclose the presintered body in a capsule and seal the capsule while heating and degassing in vacuum. By doing so, it can be prevented to be oxidized again at cooling, and a degassing effect in the capsule is raised very highly.

HIP treatment can be conducted using argon gas or nitrogen gas. Then, the capsule is removed from the sintered bodies, the sintered body is finished through machining into a predetermined shape of electrode.

DESCRIPTION OF THE EMBODIMENT

Figure 1:
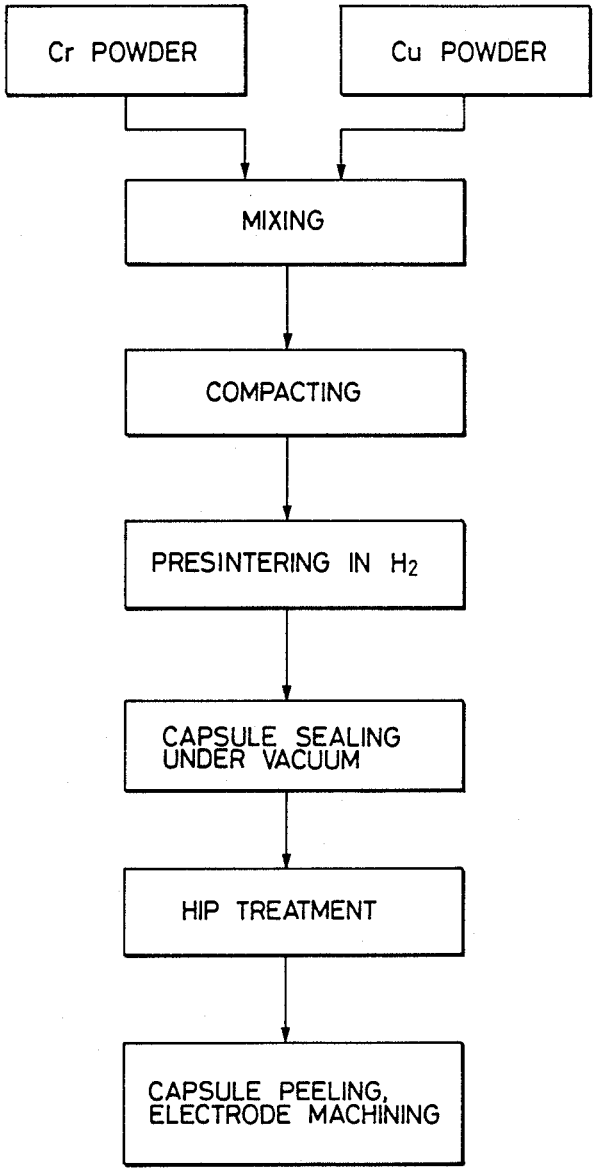
FIG. 1 is a flow chart showing a production process of the invention.

Cr powder of particles with a diameter of about 70 μm and Cu powder of particles with a diameter of about 50 μm are used, 60, 80, 90 wt % of Cr, and the remaining Cu are mixed, respectively, by a dry type method, and electrodes are produced according to the process shown in FIG. 1.

Figure 2:
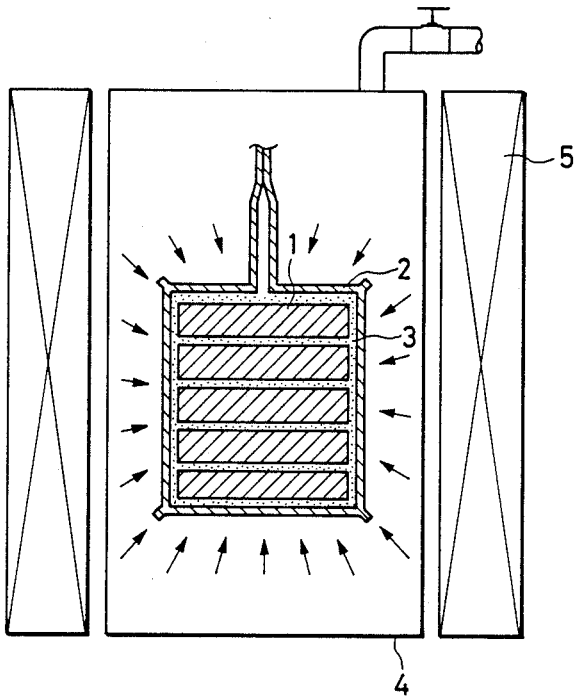
FIG. 2 is a schematic view of a hot isostatic pressing treatment apparatus.

Mixing is conducted using an automatic mortar for about one hour. The mixed powder is compacted by a press with pressure of about 3000 kg/cm$^2$, into a compact with a diameter of about 50 mm and a thickness of 10 mm. The porosity of the compact is 25–30%. The compact is subjected to presintering wherein the compact is heated to a temperature of 1000° C. and held at the temperature for one hour in an atmosphere of a high purity hydrogen refined to an extent that a dew point thereof is less than −70° C. The porosity after completion of this presintering is reduced to 5–15%. Further, then, as pretreatment for HIP treatment, vacuum capsule sealing as shown in FIG. 2 is conducted. Namely, when the above-mentioned presintered body is left as it is, the density is not raised sufficiently as yet, so that in the interior of the presintered body, pores are not closed completely. Therefore, when presintered body as it is subjected to HIP treatment without using the capsule, the presintered body can not be made dense. Therefore, the presintered body is enclosed in the capsule, and sealed under vacuum. Every capsule is subjected to the HIP treatment.

In this example, a capsule 2 of soft steel with a thickness of 3 mm is used, and the capsule is heated to about 900° C. and hermetically sealed under vacuum while exhausting the capsule and degassing. Further, when a plurality of the presintered bodies 1 are enclosed in the capsule at the same time and subjected to the HIP treatment, the presintered bodies 1 are adhered to one another and can not be separated. Therefore, alumina powder 3 is packed in gaps between the capsule 2 and the respective presintered bodies 1 as shown in FIG. 2. Reference numerals 4 and 5 indicate a chamber and a heating furnace, respectively.

The capsule sealed in an above-mentioned manner is disposed in the chamber 4 and subjected to the HIP treatment. A pressure medium is argon gas introduced in the chamber 4, and compression force is about 2000 kg/cm$^2$. Arrows in FIG. 2 show that static pressure is applied by the argon gas. A heating temperature is 1300° C. By this HIP treatment, Cu component in the sintered body is made completely into a liquid phase, whereby a liquid-phase sintering is effected.

Electric performance as a vacuum circuit breaker electrode is examined using electrodes produced in the above-mentioned manner. The result are shown in the table and FIG. 3. Further, as comparative material, an a electrode produced by impregnating a porous sintered body of Cr powder with Cu is employed and its performance is listed therein.

In a withstand voltage test, impulse voltage is applied in steps of 5 kV after cleaning the electrode which is subjected to interruption of 10 times, and discharge voltage is measured. Distance between the electrodes is 2.5 mm. Measurement is effected 10 times. Measurement of chopping current is practiced 100 times using a low voltage circuit of 100 V, and maximum values and average values are obtained. In the interruption performance test, the interruption current is caused to increase from 500 A to 1000 A in a stepped manner and the voltage is applied to increase at the same, and the interruption ability is obtained. In this case, a diameter of the electrode is 20 mm.

TABLE

| | Electrode Material and Performance | | | | |
|---|---|---|---|---|---|
| | | Impulse Withstand Voltage (kV) | Chopping Current (A) | | Interruption |
| No. | Electrode Material | Average | Max. | Average | Ability (kA) |
| 1 | Cr—10Cu | 113 | 6.0 | 4.2 | more than 11.0 |
| 2 | Cr—20Cu | 113 | 5.8 | 3.8 | more than 11.0 |
| 3 | Cr—40Cu | 113 | 5.3 | 3.4 | more than 11.0 |
| 4 | Cr—40Cu (comparative material) | 94 | 5.1 | 3.1 | more than 11.0 |

Figure 3:
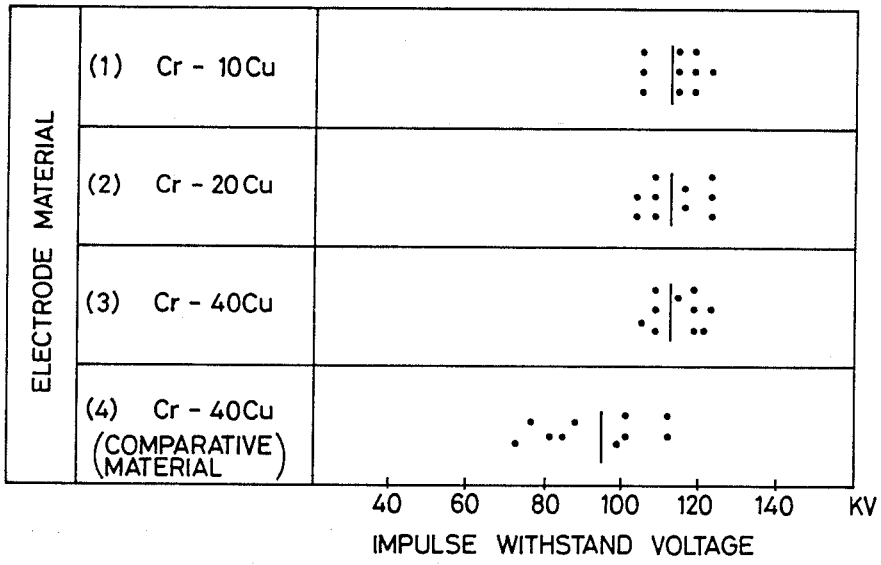
FIG. 3 is a graphical illustration showing results of withstand voltage test on various electrode materials.

The electrodes of No. 1–3 according to the invention is higher in withstand voltage and little in variation of the withstand voltage, compared with the comparative material No. 4, as shown in FIG. 3. There is no large difference between the electrodes of No. 1–4, with respect to the chopping current and the interruption ability.

We claim:

1. A process of producing electrodes for vacuum circuit breakers, which comprises the steps of:

mixing conductive metal powder, including at least one element selected from a group consisting of Cu and Ag, and refractory material powder having a higher melting point than said conductive metal powder, to form a resultant mixture;

compacting the resultant mixture;

presintering the compact in a hydrogen atmosphere to form a presintered body; and subjecting said presintered body to hot isostatic pressing treatment at a temperature higher than in the presintering step thereby to sinter under liquid phase so that said conductive metal is melted at the time of said hot isostatic pressing treatment.

2. The process of producing electrodes for vacuum circuit breakers according to claim 1, wherein said presintering is practiced in an atmosphere of hydrogen of high purity of less than −70° C. of dew point.

3. The process of producing electrodes for vacuum circuit breakers according to claim 1, wherein said refractor powder is Cr powder.

4. The process of producing electrodes for vacuum circuit breakers according to claim 1, wherein porosity of said presintered body is less than 20%.

5. The process of producing electrodes for vacuum circuit breakers according to claim 1, wherein the upper limit of heating temperature in said hot isostatic pressing treatment is a temperature which is 200° C. higher than a melting point of said conductive metal.

6. The process of producing electrodes for vacuum circuit breakers according to claim 1, further including a step of sealing said presintered body into a capsule while exhausting, heating and degassing, at the time of said hot isostatic pressing treatment.

7. A process of producing an electrodes for vacuum circuit breakers according to claim 1, wherein molten metal seeps out on the body surface at the time of said hot isostatic pressing.

8. The process of producing electrodes for vacuum circuit breakers according to claim 1, wherein the refractory material powder is of at least one refractory material selected from the group consisting of Cr, Co, Fe, Mo. W, Ta and Ni.

9. The process of producing electrodes for vacuum circuit breakers according to claim 1, wherein a powder of a low melting point metal is mixed with the conductive metal powder and the refractory material powder in the mixing step, the electrodes produced containing low melting point metal in addition to the conductive metal and refractory material.

10. The process of producing electrodes for vacuum circuit breakers according to claim 9, wherein the low melting point metal is at least one element selected from the group consisting of Pb, Bi and Sn.

11. The process of producing electrodes for vacuum circuit breakers according to claim 9, wherein the amount of low melting point metal in the produced electrodes is less than 5% of the weight of the electrodes.

12. The process of producing electrodes for vacuum circuit breakers according to claim 1, wherein the refractory material is a ceramic.

13. The process of producing electrodes for vacuum circuit breakers according to claim 1, wherein the amount of refractory material in the produced electrodes is 50–90% of the weight of the electrodes.

14. The process of producing electrodes for vacuum circuit breakers according to claim 1, wherein the particle sizes of the conductive metal powder and refractory material powder is less than 200 μm.

15. The process of producing electrodes for vacuum circuit breakers according to claim 14, wherein the particle sizes of the conductive metal powder and refractory material powder is less than 100 μm.

16. The process of producing electrodes for vacuum circuit breakers according to claim 1, wherein the resultant mixture is formed in the shape of an electrode, and is in said shape when compacted.

17. A process of producing electrodes for vacuum circuit brakers, which comprises the steps of:

mixing Cu powder and Cr powder, to form a resultant mixture;

compacting the resultant mixture to form a compact;

presintering said compact in an atmosphere of high purity hydrogen at a temperature immediately below a melting point of Cu so that sintering under solid under phase is effected;

sealing in a capsule a plurality of presintered bodies, formed in said presintering step, together with a medium for separating the presintered bodies from each other so as to prevent said presintered bodies from adhering to each other while exhausting said capsule, heating and degassing;

subjecting said vacuum sealed capsule to hot isostatic pressing treatment at a temperature between a melting point of Cu and a temperature which is higher by 200° C. than the melting point of Cu, whereby said presintered bodies are sintered under liquid phase, a Cu component of each sintered body being melted and a part of the molten Cu seeping out on a surface of said sintered body;

removing said sintered bodies from said capsule; and subjecting each sintered body to machining to form an electrode.

18. A process of producing an electrode for vacuum circuit breaker according to claim 17, wherein said medium is alumina powder.

* * * * *